US011835050B2

(12) United States Patent
Ying

(10) Patent No.: US 11,835,050 B2
(45) Date of Patent: Dec. 5, 2023

(54) FAN

(71) Applicant: Hui Ying, Yongkang (CN)

(72) Inventor: Hui Ying, Yongkang (CN)

( * ) Notice: Subject to any disclaimer, the term of this patent is extended or adjusted under 35 U.S.C. 154(b) by 0 days.

(21) Appl. No.: 17/755,404

(22) PCT Filed: Oct. 29, 2020

(86) PCT No.: PCT/CN2020/124877
§ 371 (c)(1),
(2) Date: Apr. 28, 2022

(87) PCT Pub. No.: WO2021/083283
PCT Pub. Date: May 6, 2021

(65) Prior Publication Data

US 2022/0397120 A1 Dec. 15, 2022

(30) Foreign Application Priority Data

Oct. 31, 2019 (CN) ..... 201911052385.5
Oct. 31, 2019 (CN) ..... 201911053260.4
(Continued)

(51) Int. Cl.
*F04D 25/08* (2006.01)
*F04D 29/40* (2006.01)
(Continued)

(52) U.S. Cl.
CPC ..... *F04D 25/08* (2013.01); *F04D 29/403* (2013.01); *F04D 29/601* (2013.01); *F04D 29/703* (2013.01); *F04F 5/06* (2013.01)

(58) Field of Classification Search
CPC ..... F04D 17/162; F04D 25/08; F04D 25/10–105; F04D 29/403; F04D 29/601; F04D 29/70–703; F04F 5/16
See application file for complete search history.

(56) References Cited

U.S. PATENT DOCUMENTS

2009/0060710 A1* 3/2009 Gammack ..... F04F 5/46 417/423.1
2010/0226797 A1* 9/2010 Fitton ..... F24F 7/06 417/313
(Continued)

FOREIGN PATENT DOCUMENTS

CN 104047908 A 9/2014
CN 104100499 A 10/2014
(Continued)

OTHER PUBLICATIONS

The International Search Report dated Jan. 27, 2021 for PCT international application No. PCT/CN2020/124877.

*Primary Examiner* — Alexander B Comley
(74) *Attorney, Agent, or Firm* — Thomas Horstemeyer, LLP

(57) ABSTRACT

The disclosure describes a fan, which includes a body, the body includes a first air inlet, a second air inlet, an air outlet, and a fan motor for generating an air flow passing through the body, wherein the first air inlet and the second air inlet are arranged at interval in a first direction; a nozzle, which is connected with the air outlet and used for receiving the air flow from the body and ejecting the air flow; and a filter, which is arranged in a region between the first and the second air inlet in the body, and disposed downstream of the air inlet. The fan makes the air pass through the filter more evenly, prolongs the life of the filter, reduces filter replacements, reduces the cost of the air purifier, and is more conducive to the improvement of the indoor environment and provides a cleaner living environment.

13 Claims, 27 Drawing Sheets

(30) Foreign Application Priority Data

Oct. 31, 2019 (CN) ..... 201921857000.8
Oct. 31, 2019 (CN) ..... 201921873815.5

(51) Int. Cl.

| | |
|---|---|
| ***F04D 29/60*** | (2006.01) |
| ***F04D 29/70*** | (2006.01) |
| ***F04F 5/16*** | (2006.01) |
| ***F04F 5/06*** | (2006.01) |

(56) References Cited

U.S. PATENT DOCUMENTS

2011/0236228 A1* 9/2011 Fitton ..... F04D 25/084
417/234
2012/0114513 A1* 5/2012 Simmonds ..... F04D 25/08
137/833
2013/0323100 A1* 12/2013 Poulton ..... F04D 25/08
415/220
2014/0255173 A1* 9/2014 Poulton ..... F04D 25/08
415/182.1
2016/0238037 A1* 8/2016 Peet ..... F04D 29/403
2019/0168150 A1* 6/2019 Biltcliffe ..... F04D 29/403
2019/0170162 A1* 6/2019 Jennings ..... F04D 19/002

FOREIGN PATENT DOCUMENTS

| | | | |
|---|---|---|---|
| CN | 205747194 | U | 11/2016 |
| CN | 108043140 | A | 5/2018 |
| CN | 208764002 | U | 4/2019 |
| CN | 109869344 | A | 6/2019 |
| CN | 110645194 | A | 1/2020 |
| CN | 110685941 | A | 1/2020 |
| CN | 210919519 | U | 7/2020 |
| CN | 210949212 | U | 7/2020 |
| GB | 2510197 | A | 7/2014 |

* cited by examiner

FAN

CROSS-REFERENCE TO RELATED APPLICATIONS

This application claims the benefit of PCT patent application No. PCT/CN2020/124877 filed on Oct. 29, 2020, which is based upon and claims priority to Chinese Patent Applications No. 201911053260.4, No. 201921873815.5, No. 201911052385.5 and No. 201921857000.8, filed on Oct. 31, 2019. The entire contents both applications are incorporated herein by reference in their entireties.

TECHNICAL FIELD

The present disclosure relates generally to cooling technology, and more particularly to a bladeless fan for purifying air.

BACKGROUND

With the improvement of scientific and technological level, the requirements for high-quality life are also increasing, and indoor air quality has become one of the important indicators that people are concerning. Especially, with the emergence of environmental pollution, such as smog and PM2.5 in recent years, the demands for air purifiers are also increasing.

Air purifiers are small household appliances used to purify indoor air, and they mainly solve indoor air pollution due to decoration or other reasons. Due to the persistence and uncertainty of the release of pollutants in indoor air, purifying indoor air with air purifiers is an internationally recognized method for improving indoor air quality. There are many different technologies and filter media in air purifiers that enable them to provide clean and safe air for the user. Commonly used air purification technologies include low-temperature asymmetric plasma air purification technology, adsorption technology, negative ion technology, negative oxygen ion technology, molecular complex technology, nano-$TiO_2$ technology, high efficiency particulate air filter (HEPA) technology, electrostatic dust collection technology, active oxygen technology, etc.; Filter media related technologies mainly include photo catalysts, activated carbon, synthetic fibers, high-efficiency materials of HEPA, etc. The cost of high-quality filters will account for 20% to 30% of the total cost of air purifiers.

At present, many bladeless fan assemblies with air filters have appeared. FIG. 1 is a cross-sectional view of a bladeless fan with an air filter in the prior art. As shown in FIG. 1, most of fan assemblies includes a large nozzle 91, an outer shell 93, a base 94, a filter 95, a fan motor unit 96 and a mesh inner tank 97, wherein, the outer shell 93 with the air inlet mesh is arranged on the base 94, the outer shell 93 is provided with a filter 95, the filter 95 is provided with a mesh inner tank 97, and the mesh inner tank 97 is provided with first air inlets of the fan motor unit 96, the nozzle 91 is located above the outer shell 93, and the air outlet of the fan motor unit 96 communicates with the nozzle 91. The indoor air is filtered by the meshes of the outer shell 93 and the filter 95 in sequence, then enters the mesh inner tank 97 and is inhaled by the fan motor unit 96 to be pressurized and finally ejected by the nozzle 91. In this structure, in order to maximize the total area of the air inlet meshes and the area of the filter, the air inlet mesh is arranged on the entire surface of the outer shell 93, and the height of the filter 95 is the same as the height of the air inlet meshes. The air inlet meshes of the outer shell, and the filter 95 are arranged in an area with an approximately same height. However, since the first air inlet of the fan motor unit 96 is usually arranged in the area close to the bottom of the outer shell 93 for the air suction effect, the air from the lower air inlet meshes can reach the first air inlets of the fan motor unit 96 in an almost linear manner, the suction force to the air is larger due to the shorter distance it raveled; and the air from the upper air inlet meshes needs to go through a longer route to reach the first air inlets and the suction force to the air is significantly smaller. In this case, the suction forces of the fan motor unit 96 to the air from the air inlet meshes of different heights are varied seriously, the suction volume near the air inlet meshes at the bottom of the outer shell 93 will be significantly larger than the suction volume far from the air inlet meshes at the bottom of the outer shell 93, the difference between them reaches 2.5 times to 3 times, which makes the status of the filter of different areas significantly different. That is, after a period of use, the bottom filter 95 near the bottom of the outer shell 93 becomes the heavily used portion 95B, and the upper filter 95 away from the bottom of the outer shell 93 becomes the lightly used portion 95A, in this case, the filter screen part 95B that mainly filters the air must be replaced since it has been severely used. The above structure greatly shortens the life of the filter 95, and causes many filters to be discarded without being fully used, resulting in a waste of resources.

Moreover, the outer shell of this type of bladeless fan is a structure in which two shells are horizontally abutted, and each shell is provided with a filter. The filter 95 is sealed with the mesh inner tank 97 through a three-dimensional sealing strip arranged downstream, the cost of the three-dimensional sealing strip is extremely high and the sealing effect is poor after long-term use. In addition, when replacing the filter 95, it is necessary to disassemble the two shells respectively to replace the filter and then install it back, which is a cumbersome process and is not a user-friendly experience.

SUMMARY

In order to overcome the current technical hurdles, the present disclosure provides a bladeless fan for purifying air, which makes the airflow pass through the filter more evenly, thereby prolonging the life of the filter, reducing the replacement of the filter and reducing the cost of the air purifier. It is more conducive to the improvement of the indoor environment and provides a cleaner living environment. This technology is beneficial to the improvement of the indoor environment and then provides a cleaner living environment.

The present disclosure provides a fan including a body including a first air inlet, a second air inlet, an air outlet and a fan motor unit for generating an airflow flowing through the body, wherein, the first air inlet and the second air inlet are arranged at intervals along an first direction; a nozzle connected to the air outlet, the nozzle being arranged to receive the airflow from the body and to eject the airflow; and a filter mounted in the body and located between the first air inlet and the second air inlet, and disposed downstream of the first air inlet and the second air inlet.

In some embodiments of the present disclosure, a heater is provided in an inner passage of the nozzle, and at least a part of the airflow received in the inner passage passes through the heater and is discharged from an outlet of the nozzle, and a longitudinal center plane of the outlet of the nozzle and a longitudinal center plane of the heater are parallel to each other or on a same plane.

In some embodiments of the present disclosure, the inner passage of the nozzle is provided with an air collecting chamber, the air collecting chamber is provided with a heater, an inlet of the air collecting chamber is communicated with the inner passage, and an outlet of the air collecting chamber is communicated with the outlet of the nozzle, an insulation passage is formed between the heater and an inner wall of the air collecting chamber, after the airflow received in the inner passage enters the air collecting chamber from the inlet of the air collecting chamber, a part of the airflow passes through the heater and another part of the airflow passes through the insulation passage.

In some embodiments of the present disclosure, an airflow passing through the heater and an airflow passing through the insulation passage are both conveyed from the outlet of the air collecting chamber to the outlet of the nozzle, and a plurality of support ribs are arranged in the insulation passage, and one end of support rib is connected to an inner wall of the air collecting chamber, and another end of support rib is abutted to an outer wall of the heater.

In some embodiments of the present disclosure, the air collecting chamber includes a first chamber and a second chamber communicating with the first chamber; the portion between the inlet of the air collecting chamber and the second chamber is the first chamber, and the portion between an end of the first chamber and the outlet of the air collecting chamber is the second chamber; the heater is arranged in the first chamber, both the airflow passing through the heater and the airflow passing through the insulation passage enter the second chamber and are conveyed from the outlet of the air collecting chamber to the outlet of the nozzle.

In some embodiments of the present disclosure, the outlet of the air collecting chamber is configured as a tapered structure, and the tapered structure includes two air guide surfaces that gradually taper from the air collecting chamber to the outlet of the nozzle, and the two guide surfaces are symmetrically arranged based on a center of the outlet of the nozzle.

In some embodiments of the present disclosure, the body includes an outer shell, the first air inlet and the second air inlet are respectively provided at two ends of the outer shell, and at least a portion of the outer shell forms a diffusion passage that guides the airflow into the filter.

In some embodiments of the present disclosure, an upstream surface of the filter is exposed to the diffusion passage.

In some embodiments of the present disclosure, the first direction is a direction along a height of the body.

In some embodiments of the present disclosure, the outer shell is barrel-shaped; the filter includes a tubular filter and the tubular filter is arranged on an inner circumference of the barrel-shaped outer shell, and a tubular gap between an upstream surface of the tubular filter and the inner wall of the barrel-shaped outer shell forms the diffusion passage.

In some embodiments of the present disclosure, the body further includes an air inlet cover unit, the cover unit is detachably connected to an opening of the outer shell; at least one first air inlet surrounding the tubular filter is arranged along an edge of the cover unit, and the at least one first air inlet communicates with a first end of the diffusion passage.

In some embodiments of the present disclosure, wherein one side of the cover unit is provided with a circumferential positioning groove, and the circumferential positioning groove is detachably engaged with a first side of the tubular filter, and the first side of the tubular filter and the cover unit are sealed by a circular sealing element.

In some embodiments of the present disclosure, a second side of the tubular filter abuts a bottom of the barrel-shaped outer shell, and the second side of the tubular filter and the outer shell are sealed by a circular sealing element.

In some embodiments of the present disclosure, at least one second air inlet arranged around the tubular filter is disposed on an edge of a bottom of the barrel-shaped outer shell, and the at least one second air inlet communicates with a second end of the diffusion passage.

In some embodiments of the present disclosure, the fan further includes a base having a rotating shaft and a motor that drives the rotating shaft, and the rotating shaft supports the body.

The bladeless fan for purifying air in the present disclosure makes the airflow pass through the filter more evenly, thereby prolonging the life of the filter, reducing the replacement of the filter and reducing the cost of the air purifier. It is more conducive to the improvement of the indoor environment and provides a cleaner living environment. This technology is beneficial to the improvement of the indoor environment and then provides a cleaner living environment.

BRIEF DESCRIPTION OF THE DRAWINGS

In order to more clearly illustrate technical solutions in the embodiments of the present disclosure, the drawings used in the description of the embodiments are briefly described below. The drawings in the following description are merely some embodiments of the present disclosure. Those skilled in the art can also obtain other drawings based on these drawings without any creative labor.

DETAILED DESCRIPTION

To better illustrate the purpose of the present disclosure, technical proposal and advantages thereof, embodiments of the present disclosure will be described in detail with reference to the drawings. It should be readily understood that both the embodiments and the drawings are explanatory for the present disclosure only, and are not intended as a limitation on the scope of the present disclosure.

Figure 1:
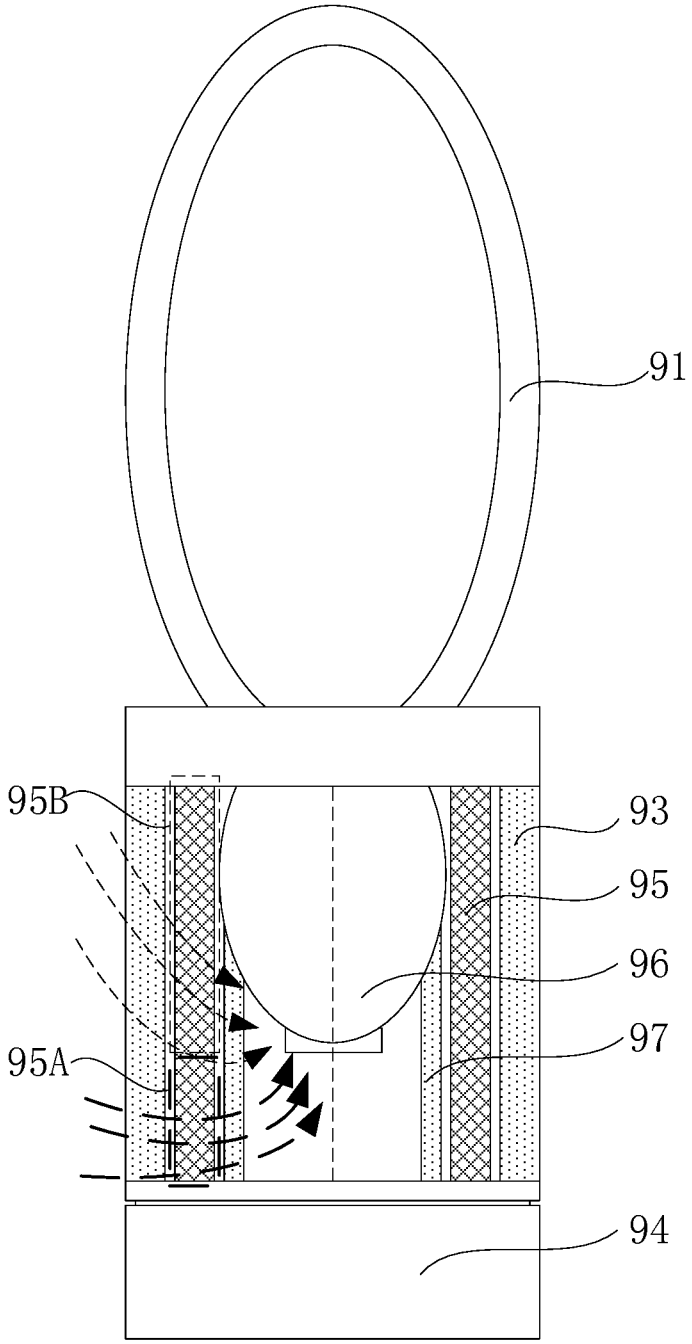
FIG. 1(Prior Art)
FIG. 1 is a cross-sectional view of a bladeless fan with a filter frame in the prior art.
Figure 2:
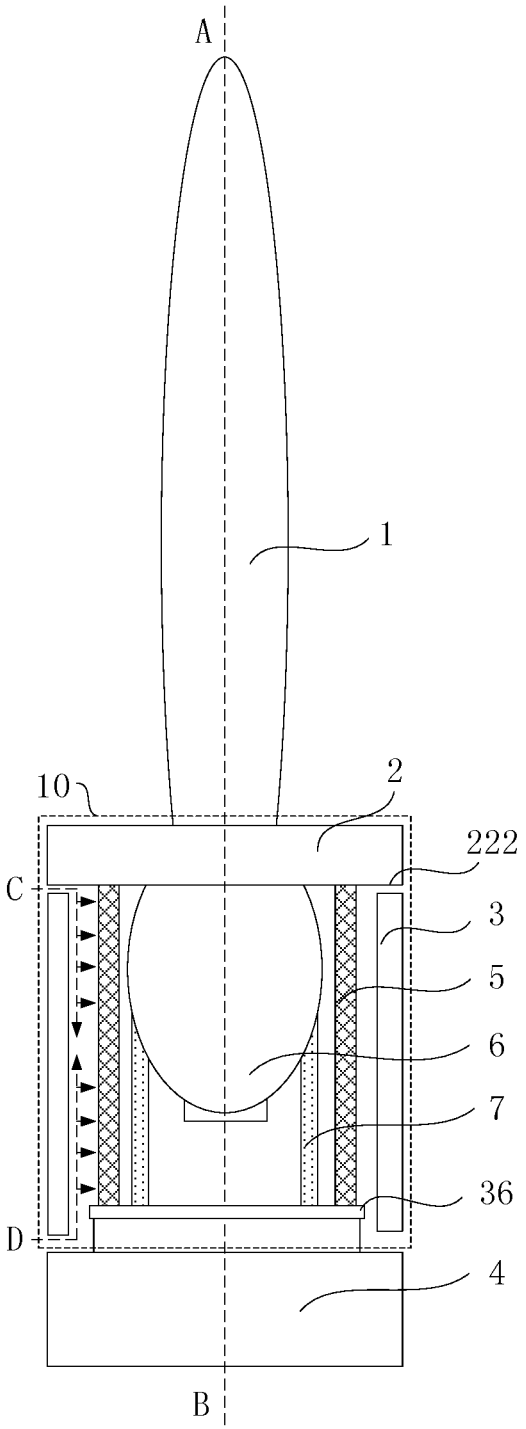
FIG. 2 is a schematic diagram of a bladeless fan according to an embodiment of the present disclosure.
Figure 3:
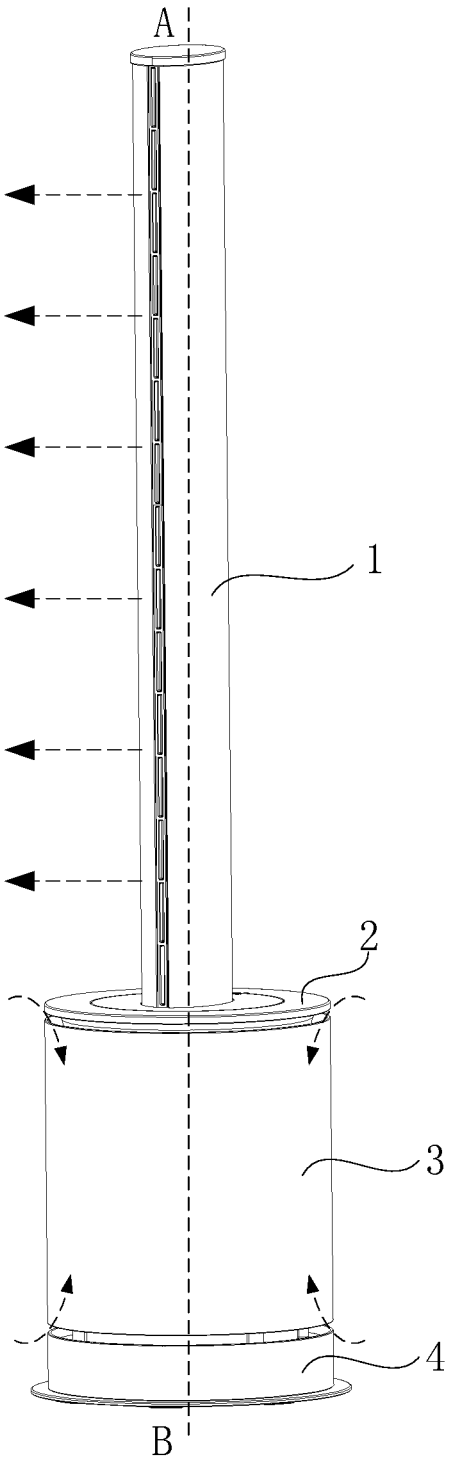
FIG. 3 is a stereogram of a bladeless fan according to an embodiment of the present disclosure.

FIG. 2 and FIG. 3 are a schematic diagram and a stereogram of a bladeless fan respectively according to an embodiment of the present disclosure. As shown in FIG. 2 and FIG. 3, a bladeless fan for purifying air of the present disclosure includes a body 10, a nozzle 1, a filter 5 and a base 4. The body includes a first air inlet 222, a second air inlet 36, an air outlet and a fan motor unit for generating an airflow through body 10, the first air inlet 222 and the second air inlet 36 are arranged at intervals along a first direction, the first direction is the direction along the height of the body 10, that is, the direction defined by A and B in the figure. In this embodiment, the first direction is also the direction of the rotation axis around which the base 4 rotates the body 10 and/or the direction in which the fan motor unit 6 guides the airflow, but the first direction is not limited thereto. The nozzle 1 is connected to the air outlet, and arranged to receive the airflow from the body 10 and to eject the airflow. The filter 5 is mounted in the body and located between the first air inlet and the second air inlet, and disposed downstream of the first air inlet and the second air inlet. The base 4 has a rotating shaft and a motor that drives the rotating shaft, and the rotating shaft supports the body 10. In this embodiment, the body 10 includes an outer shell 3, the first air inlet 222 and the second air inlet 36 are respectively provided at two ends of the outer shell 3, and at least a portion of the outer shell 3 forms a diffusion passage 33 that guides the airflow into the filter 5. In this embodiment, the diffusion passage 33 is a tubular chamber, and the axis of the tubular chamber is parallel to the first direction, but the shape of the diffusion passage is not limited to the above-mentioned shape. The outer shell is barrel-shaped; the filter 5 includes a tubular filter 53 and the tubular filter 53 is arranged on the inner circumference of the barrel-shaped outer shell, and a tubular gap between the upstream surface of the tubular filter 53 and the inner wall of the barrel-shaped outer shell forms the diffusion passage 33. The upstream surface of the filter 5 is exposed to the diffusion channel 33 in order to guide the airflow to the upstream surface of the filter 5 more uniformly. In this embodiment, the body 10 further includes an air inlet cover unit 2, and the cover unit 2 is detachably connected to an opening of the outer shell; at least one first air inlet 222 surrounding the tubular filter is arranged along an edge of the cover unit, and the at least one first air inlet 222 communicates with a first end of the diffusion passage 33. At least one second air inlet 36 arranged around the tubular filter 53 is disposed on the edge of a bottom of the barrel-shaped outer shell, and the at least one second air inlet 36 communicates with a second end of the diffusion passage 33. In the present embodiment, the annular upper surface of the tubular filter 53 is sealed with the air inlet cover unit by the circular sealing element, and the annular bottom surface of the tubular filter 53 is sealed with the bottom of the barrel-shaped housing by the circular sealing element. The air inlet on the outer shell of the bladeless fan for purifying air of the embodiment is not directly facing the suction port of the fan motor unit, and the airflow is more uniformly guided to the entire upstream surface of the filter 5 through the diffusion passage formed on the outer shell, so that the filter 5 can be used very uniformly, which greatly prolongs the life of the filter and reduces the replacement of the filter.

Figure 4:
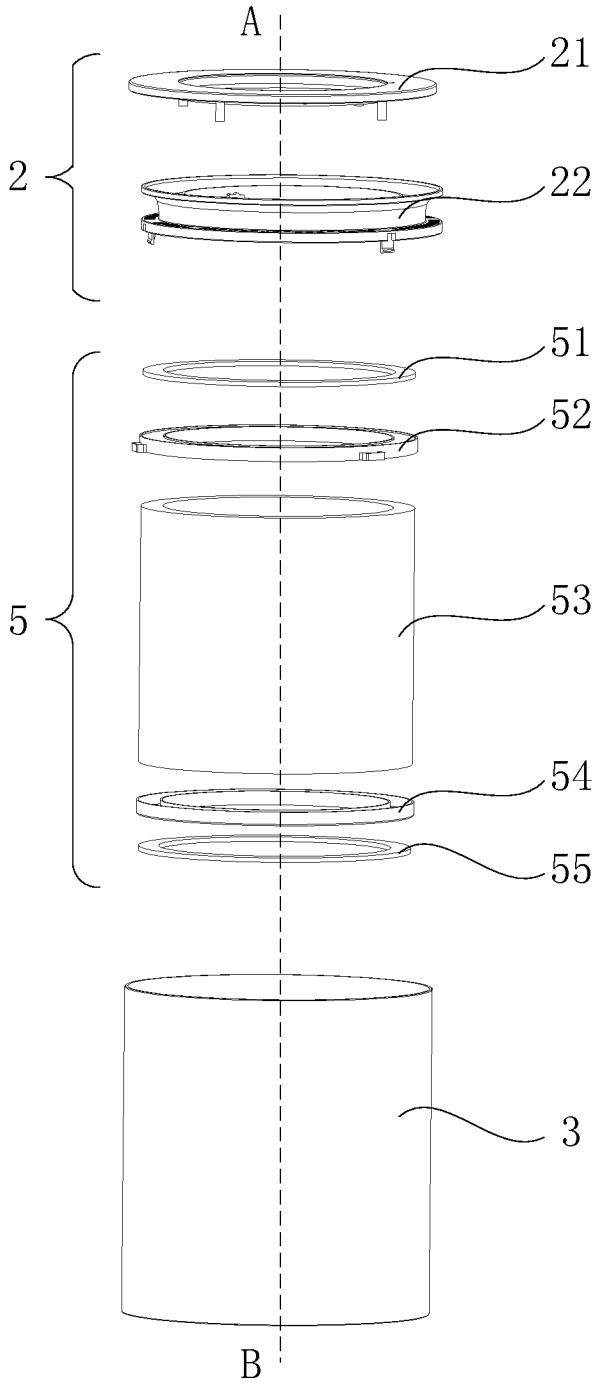
FIG. 4 is an exploded schematic diagram of a cover unit, a filter frame and an outer shell of a bladeless fan according to an embodiment of the present disclosure.
Figure 5:
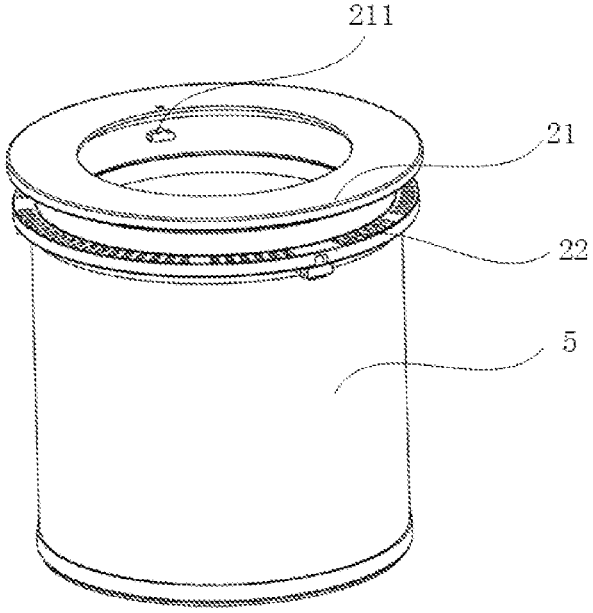
FIG. 5 is a schematic diagram of a combined state of an air inlet cover unit and a filter frame of a bladeless fan according to an embodiment of the present disclosure.
Figure 6:
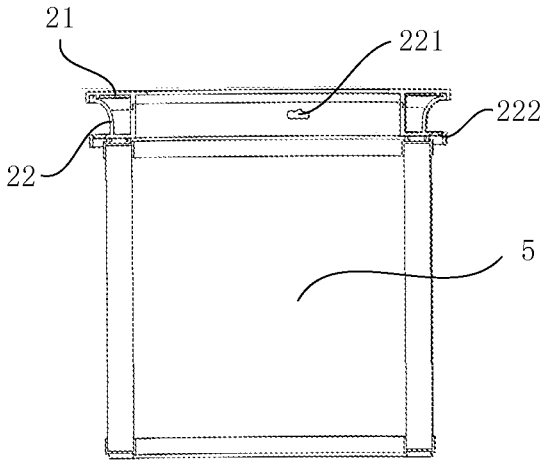
FIG. 6 is a cross-sectional view of FIG. 5.
Figure 7:
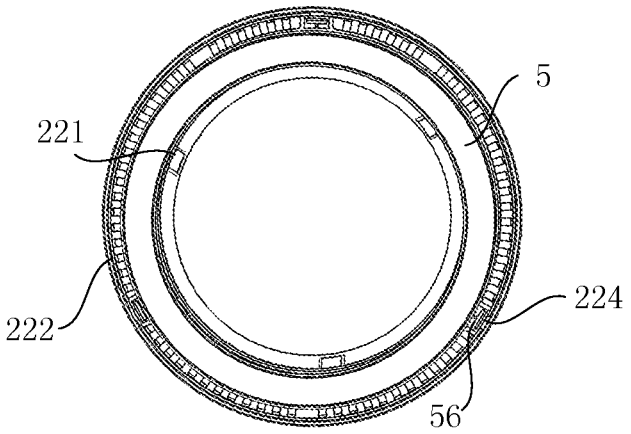
FIG. 7 is a bottom view of FIG. 5.
Figure 8:
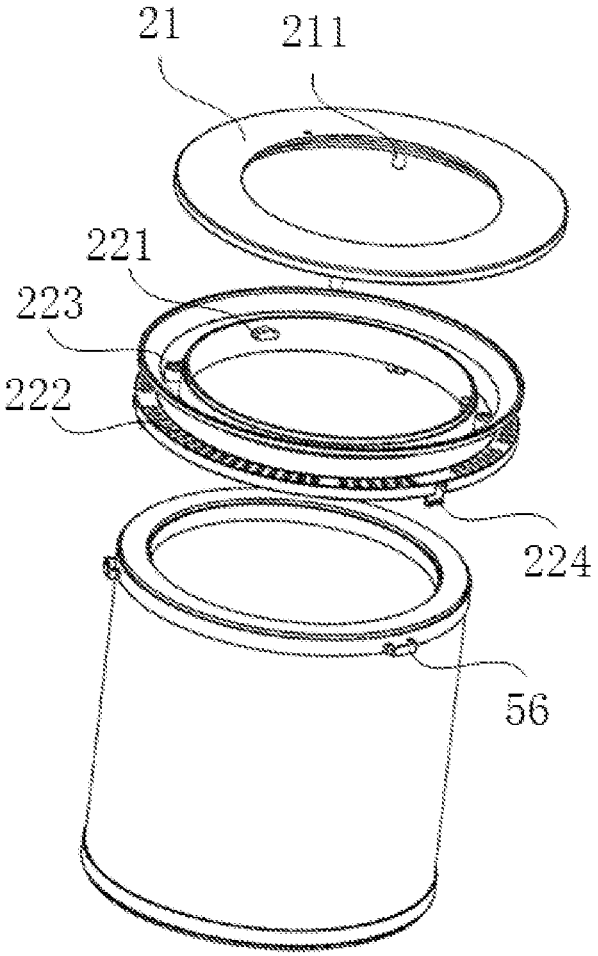
FIG. 8 is a schematic diagram of an exploded state of an air inlet cover unit and a filter frame of a bladeless fan according to an embodiment of the present disclosure.
Figure 9:
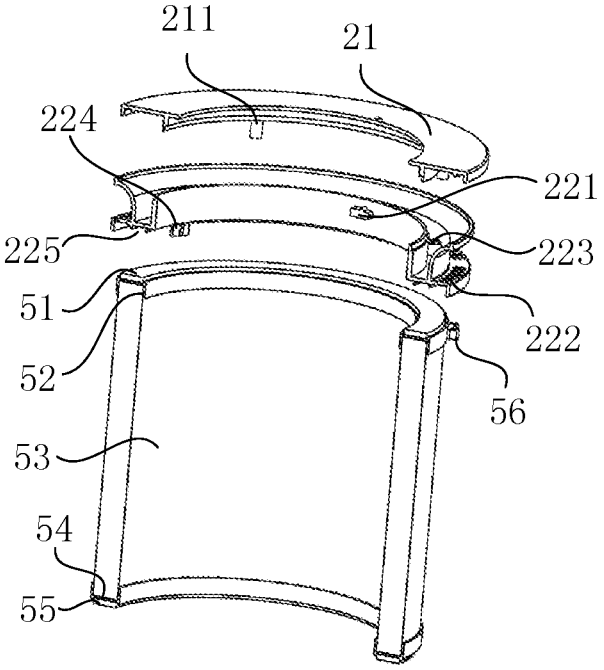
FIG. 9 is a cross-sectional view of FIG. 8.

FIG. 4 is an exploded schematic diagram of a cover unit, a filter frame and an outer shell of a bladeless fan, and FIG. 5 is a schematic diagram of a combined state of at cover unit and a filter frame of the bladeless fan according to an embodiment of the present disclosure. FIG. 6 and FIG. 7 are respectively a cross-sectional view and a bottom view of FIG. 5. FIG. 8 is a schematic diagram of an exploded state of at cover unit and a filter frame of the bladeless fan, and FIG. 9 is a cross-sectional view of FIG. 8. As shown in FIGS. 4 to 9, the cover unit 2 of the embodiment includes an annular cover plate 21 and an annular holder 22 for the filter frame, and a first side of the cover plate 21 is provided with a plurality of first positioning posts 211. The first side of the holder 22 for the filter frame is provided with a plurality of positioning holes 223, and the cover plate 21 is connected to the holder 22 for the filter frame by inserting the first positioning posts 211 into the positioning holes 223. An inner circumference of the holder 22 for the filter frame is provided with a plurality of circumferentially extending buckles 221 connected to the inner shell 7. The outer periphery of the holder 22 for the filter frame is provided with a plurality of first air inlets 222 arranged in the circumferential direction. The outer periphery of the second side of the holder 22 for the filter frame is provided with a circumferential positioning groove 225, and the circumferential positioning groove 225 is detachably engaged with a first side of the tubular filter 53, and the first side of the tubular filter 53 and the cover unit 2 are sealed by a circular sealing element. The outer periphery of the holder 22 for the filter frame is also provided with a plurality of buckles 224 which is matched with the filter 5. The holder 22 for the filter frame is sealed with the inner shell 7 through a third circular sealing element 23, and the third circular sealing element 23 is preferably a sealing ring, but it is not limited thereto.

Referring to FIGS. 4 to 9, the filter 5 of the embodiment includes a tubular air filter frame 53. A first side of the tubular filter 53 is provided a first annular positioning member 52 for fixing a first circular sealing element 51. A plurality of slots 56 are provided on the outer circumference of a first side of the tubular filter 53, and the slots 56 of the filter 5 are detachably engaged with the buckles 224 of the cover unit 2. A second side of the tubular filter 5 is provided with a second annular positioning member 54 for fixing a second circular sealing element 55. The first side of the tubular filter 53 is sealed with the cover unit 2 through the first circular sealing element 51, and the second side of the tubular filter 53 is sealed with the outer shell 3 through the second circular sealing element 55. Preferably, the material of the first circular sealing element 51 or the second circular sealing element 55 is slow-rebound sponge. The tubular filter 53 may be an existing air filter material or an air filter material to be invented in the future, but it is not limited thereto.

Figure 10:
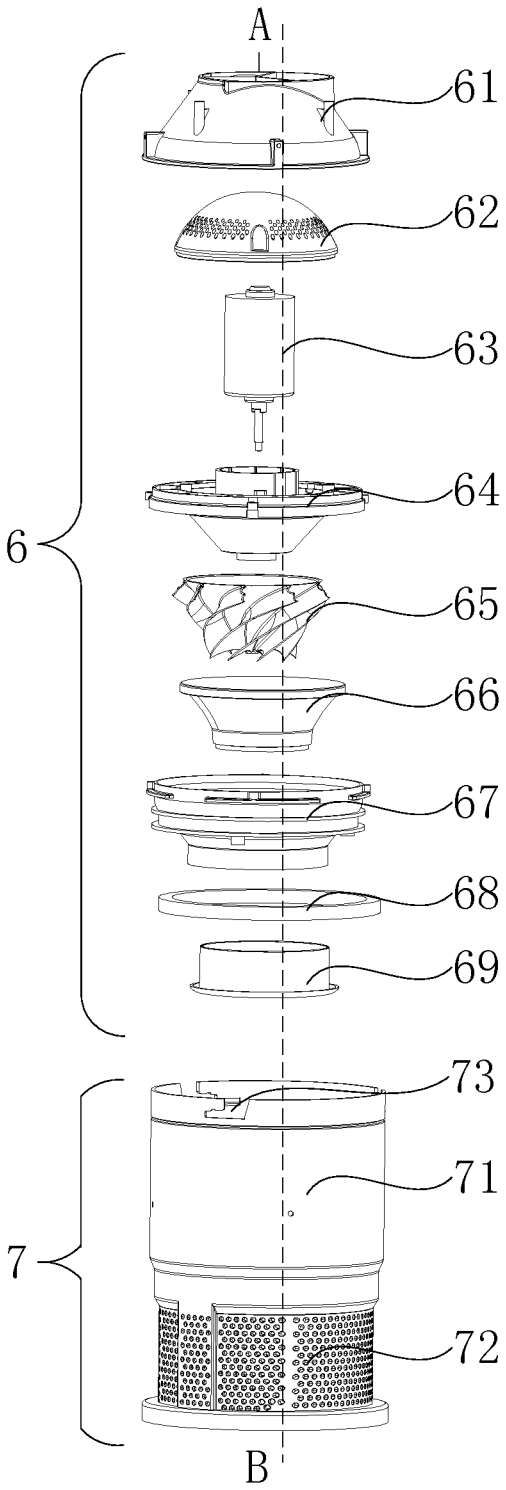
FIG. 10 is a schematic diagram of an exploded state of a motor unit and an inner shell of a bladeless fan according to an embodiment of the present disclosure.
Figure 11:
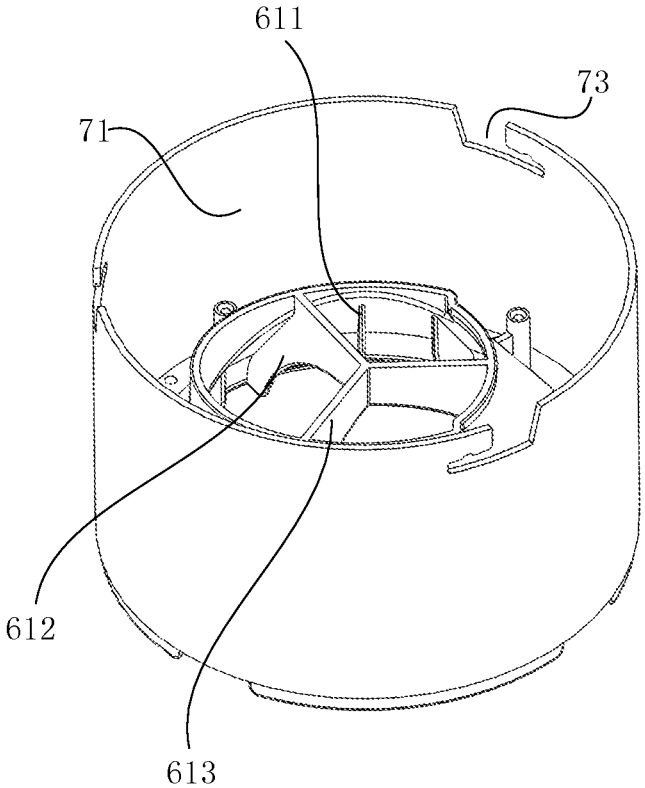
FIG. 11 is a schematic diagram of a first perspective view of a combined state of a draft hood and a connection shell of a bladeless fan according to an embodiment of the present disclosure.
Figure 12:
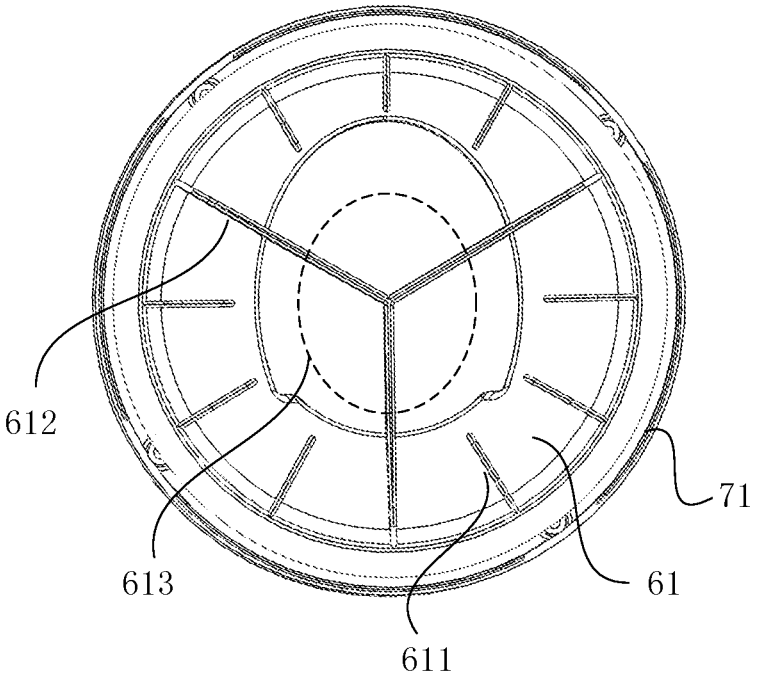
FIG. 12 is a bottom view of FIG. 11.
Figure 13:
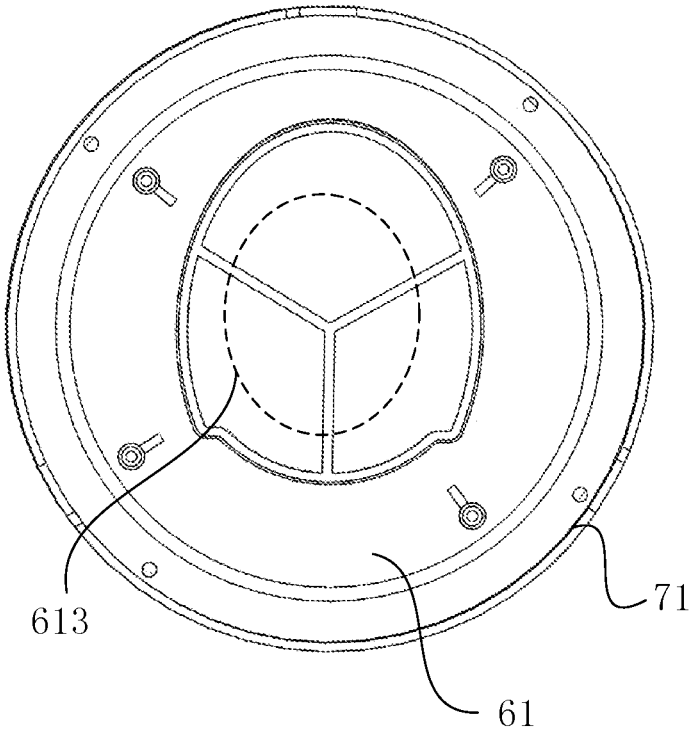
FIG. 13 is a top view of FIG. 11.
Figure 14:
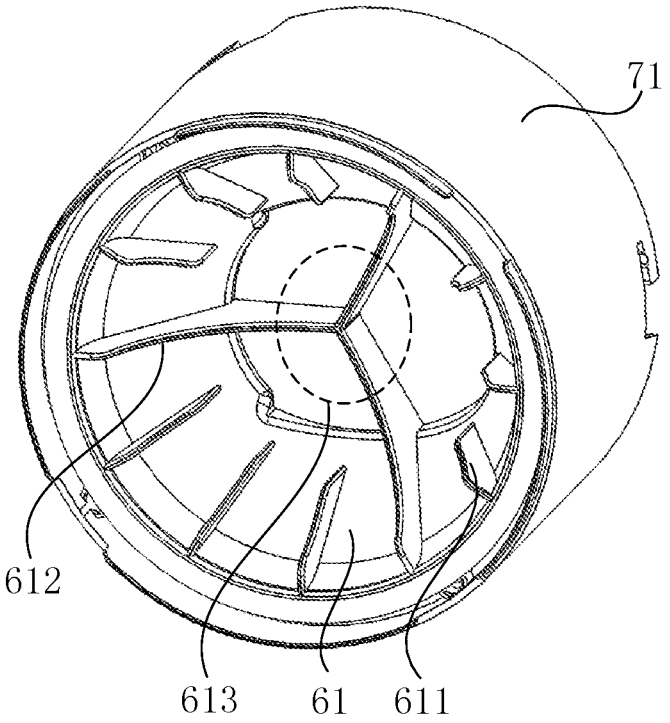
FIG. 14 is a schematic diagram of a second perspective view of a combined state of a draft hood and a connection shell of a bladeless fan according to an embodiment of the present disclosure.

FIG. 10 is a schematic diagram of an exploded state of a motor unit and an inner shell of a bladeless fan according to an embodiment of the present disclosure. FIG. 11 is a schematic diagram of a first perspective view of a combined state of a draft hood and a connection shell of the bladeless fan. FIG. 12 and FIG. 13 are respectively a bottom view and a top view of FIG. 11. FIG. 14 is a schematic diagram of a second perspective view of a combined state of a draft hood and a connection shell of the bladeless fan. As shown in FIGS. 10 to 14, the inner shell 7 of the embodiment includes a connection shell 71 and a mesh inner tank 72, and a first side of the connection shell 71 is engaged with one side of the mesh inner tank 72. The fan motor unit 6 is fixed in the connection shell 71, and the fan motor unit 6 includes a draft hood 61, an upper cover 62, a motor 63, a middle cover 64, an impeller 65, an impeller cover 66, a positioning member 67, a fourth circular sealing element 68 and a suction inlet 69. The motor 63 drives the impeller 65 to rotate, and after the airflow is guided from the mesh inner tank 72 into the fan motor unit 6 through the suction inlet 69, the pressurized airflow passes flows from the draft hood 61 to the air outlet along the first direction, and finally enters the nozzle and is sprayed outwards. The fan motor unit 6 is sealed with the mesh inner tank 72 through a fourth circular sealing element 68, which is a sponge preferably. The second side of the connection shell 71 is provided with a plurality of slots 73 which provide a circumferential sliding channel for buckles 221, so that the connection shell 71 and the plurality of buckles 221 can be detachably engaged.

Wherein, an air outlet is arranged on the draft hood 61, a guide wall on the side facing the impeller 65 of the draft hood 61 is provided with a plurality of spoilers 611 at intervals to prevent the airflow from forming a bypass at the air outlet, the guide wall of the draft hood 61 is also provided with a plurality of guide fins 612 for guiding the airflow to the air outlet. The plane of the guide fin 612 is parallel to the first direction. The guide fins 612 are merged at the air outlet to form an air guide member 613. The air guide member 613 includes a plurality of air guide walls formed by the extension of the guide fins 612. The planes of the air guide walls are parallel to the first direction, which enhances the intensity of the airflow of the fan motor unit 6 and reduces the noise of the airflow.

Figure 15:
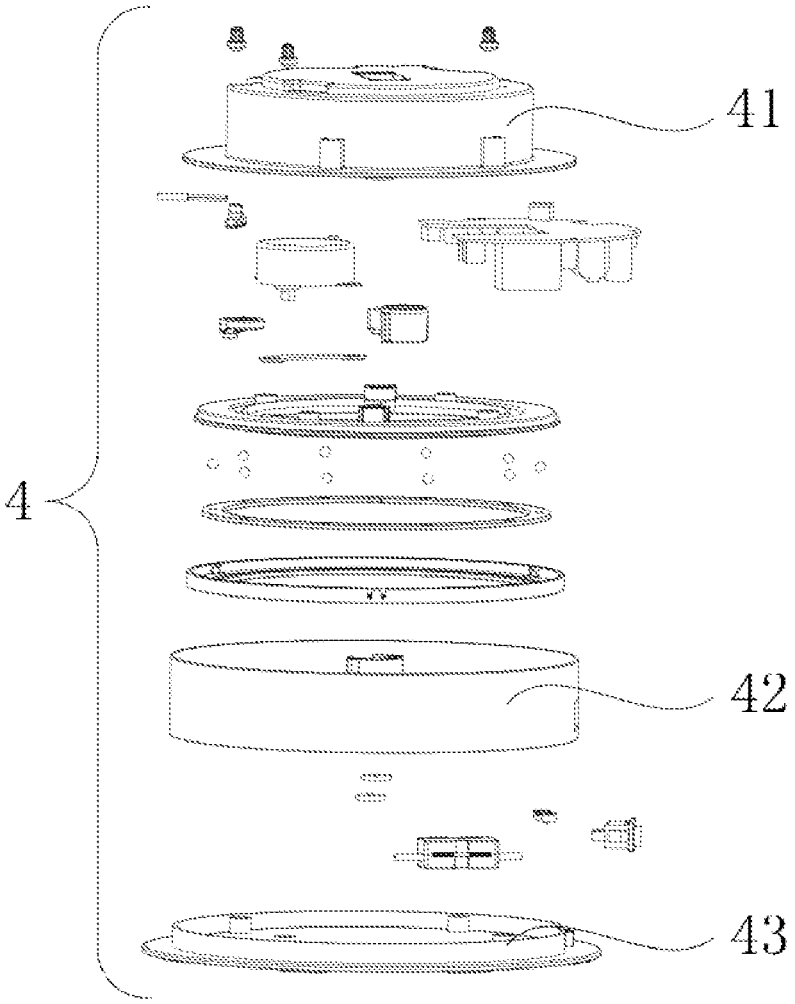
FIG. 15 is an exploded schematic view of a base of a bladeless fan according to an embodiment of the present disclosure.
Figure 16:
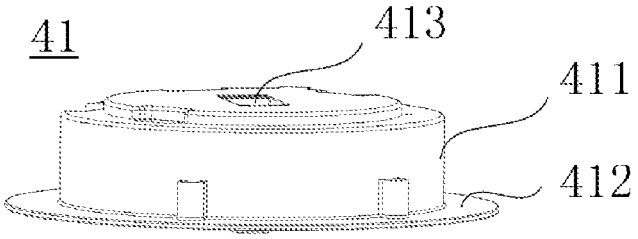
FIG. 16 is a stereogram view of a support port in a bladeless fan according to an embodiment of the present disclosure.

FIG. 15 is an exploded schematic view of a base of a bladeless fan, and FIG. 16 is a stereogram view of a support port in the bladeless fan. As shown in FIGS. 15 to 16, the base 4 of the bladeless fan of the embodiment includes a support 41, a base shell 42, a rotating motor and a bottom plate 43. Wherein, the support plate 413 in a center of the support 41 supports the bottom of the barrel-shaped outer shell, and the periphery of the support plate 413 is provided with an edge 412 whose height is smaller than that of the support plate 413. The support plate 413 and the edge 412 are connected by a sunken shoulder 411, and a space 414 is formed on the outer periphery of the support plate 413 through the sunken shoulder 411.

Figure 17:
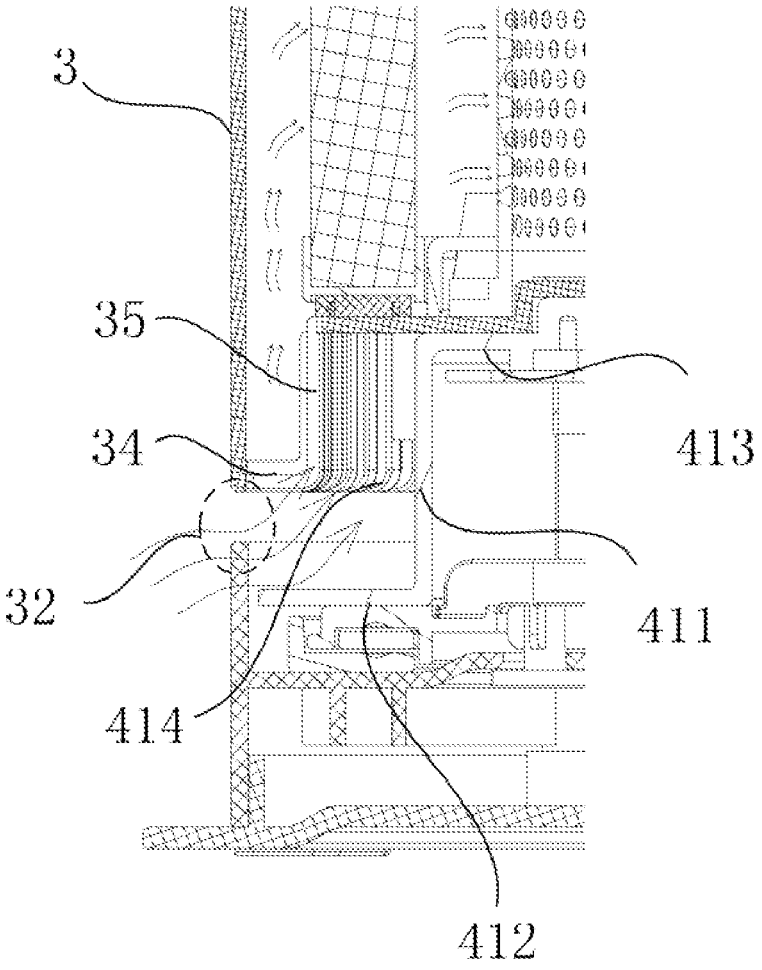
FIG. 17 is a schematic diagram illustrating the cooperation between a base and an outer shell of a bladeless fan according to an embodiment of the present disclosure.

FIG. 17 is a schematic diagram illustrating the cooperation between a base and an outer shell of a bladeless fan according to an embodiment of the present disclosure. As shown in FIG. 17, the periphery of the bottom of the barrel-shaped outer shell in the embodiment is provided with a downwardly protruding boss. The surface facing the base 4 of the boss is provided with a plurality of first openings 34 extending from a center of the barrel-shaped outer shell to the periphery, and the first openings 34 communicates with the diffusion passage 33. A plurality of second openings 35 extending along the first direction are provided on the inner side of the boss towards the center of the barrel-shaped outer shell, and the second openings 35 communicate with the diffusion passage 33. The boss is located in the space 414 around the support plate 413, so as to increase the airflow of the second air inlet channel 32 and let more airflow into the diffusion passage 33 when the height is constant.

In a preferred embodiment, a first opening 34 corresponds to a second opening 35, and each first opening 34 communicates with a second opening 35 to form a three-dimensional air inlet. In this embodiment, the projected area of the three-dimensional air inlet on a first plane is a first projected area, and the first plane (which can be regarded as a horizontal plane) is a plane perpendicular to the rotation axis of the base 4; The projected area of the three-dimensional air inlet on a second plane is a second projected area, and the second plane (which can be regarded as a vertical plane) is a plane perpendicular both to the base 4 the opening direction of the second opening 35, and the plane is also passing through the rotation axis.

In a preferred technical solution, the three-dimensional air inlet of the embodiment can be an L-shaped, and the L-shaped three-dimensional air inlet includes a plurality of first openings 34 based in a horizontal plane and a plurality of second openings 35 in a perpendicular plane. The inner end of one first opening 34 communicates with the bottom of one second openings 35 to form an L-shaped opening, which further increases the airflow of the second air inlet channel 32, but the structure of the three-dimensional air inlet is not limited thereto.

Figure 18:
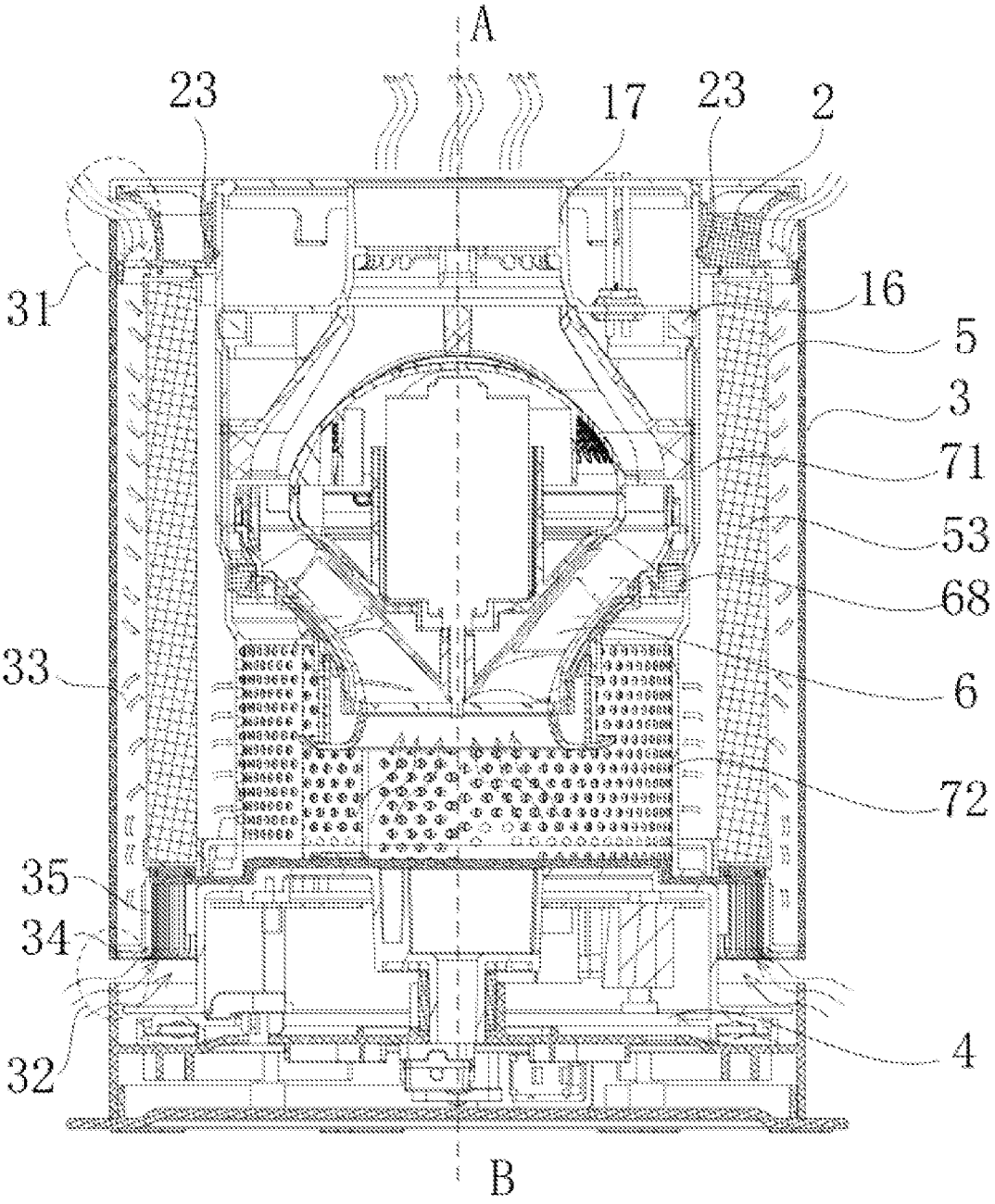
FIG. 18 is a schematic diagram of an air duct of a bladeless fan according to an embodiment of the present disclosure.

FIG. 18 is a schematic diagram of an air duct of a bladeless fan according to an embodiment of the present disclosure. As shown in FIG. 18, the cover plate 21 has an arc-shaped air guide edge, and the outer shell 3 has an annular edge protruding from the holder 22 for the filter frame. The arc-shaped air guide edge cooperates with the annular edge to form a first annular air guide slit for guiding the airflow into the first air inlets 222. A first opening of the first annular air guide slit is perpendicular to the first direction. A second opening of the first annular air guide slit is parallel to the first direction and communicates with the first air inlets 222. In this embodiment, the first annular air guide slit serves as the first air inlet channel 31 for air intake in the upper part of the outer shell 3, but it is not limited thereto. A second annular air guide slit for guiding the airflow into the second air inlets 36 is formed between the base 4 and the bottom of outer shell 3. A first opening of the second annular air guide slit is perpendicular to the first direction. A second opening of the second annular air guide slit is parallel to the first direction and communicates with the space 414, so as to avoid directly sucking air from the ground and reduce the dust entering the bladeless fan, and setting the avoidance space 414 allows part of the dust to have a chance to deposit at the bottom of the avoidance space 414, therefore a space for dust deposition is further provided. In addition, the space 414 allows part of the dust to be deposited at the bottom of itself, thereby further providing a space for dust to settle. The first opening 34 and the second opening 35 are exposed in the space 41. In this embodiment, the second annular air guide slit serves as the second air inlet channel 32 for air intake in the bottom part of the outer shell 3, but it is not limited thereto.

When the bladeless fan of the embodiment is running, the fan motor unit 6 rotates to inhale the airflow, and guides the airflow around the bladeless fan from respectively the first air inlet channel 31 in the upper part of the outer shell 3 and the second annular air inlet in the bottom part of the outer shell 3 to the diffusion passage 33 between the outer shell 3 and the tubular filter 53; then the airflow is diffused in the diffusion passage 33, so that the airflow is more evenly guided to the entire upstream surface of the filter 5, the clean airflow filtered by the filter 5 passes through the mesh inner tank 72 and is sucked into the fan motor unit 6, and the pressurized airflow flows to the air outlet along the first direction, and finally enters the nozzle and is sprayed outward. During the whole process, the upper part of the tubular filter 53 is mainly used to filter the airflow from the first air inlet passage 31, the bottom part of the tubular filter 53 is mainly used to filter the airflow from the second air inlet passage 32, and the middle part of the tubular filter 53 can filter the airflow which comes from the first air inlet passage 31 and the second air inlet passage 32 and then are diffused through the diffusion passage 33. The three parts of the tubular filter 53 can be used very uniformly, which greatly prolongs the life of the filter and reduces the replacement of the filter.

Figure 19:
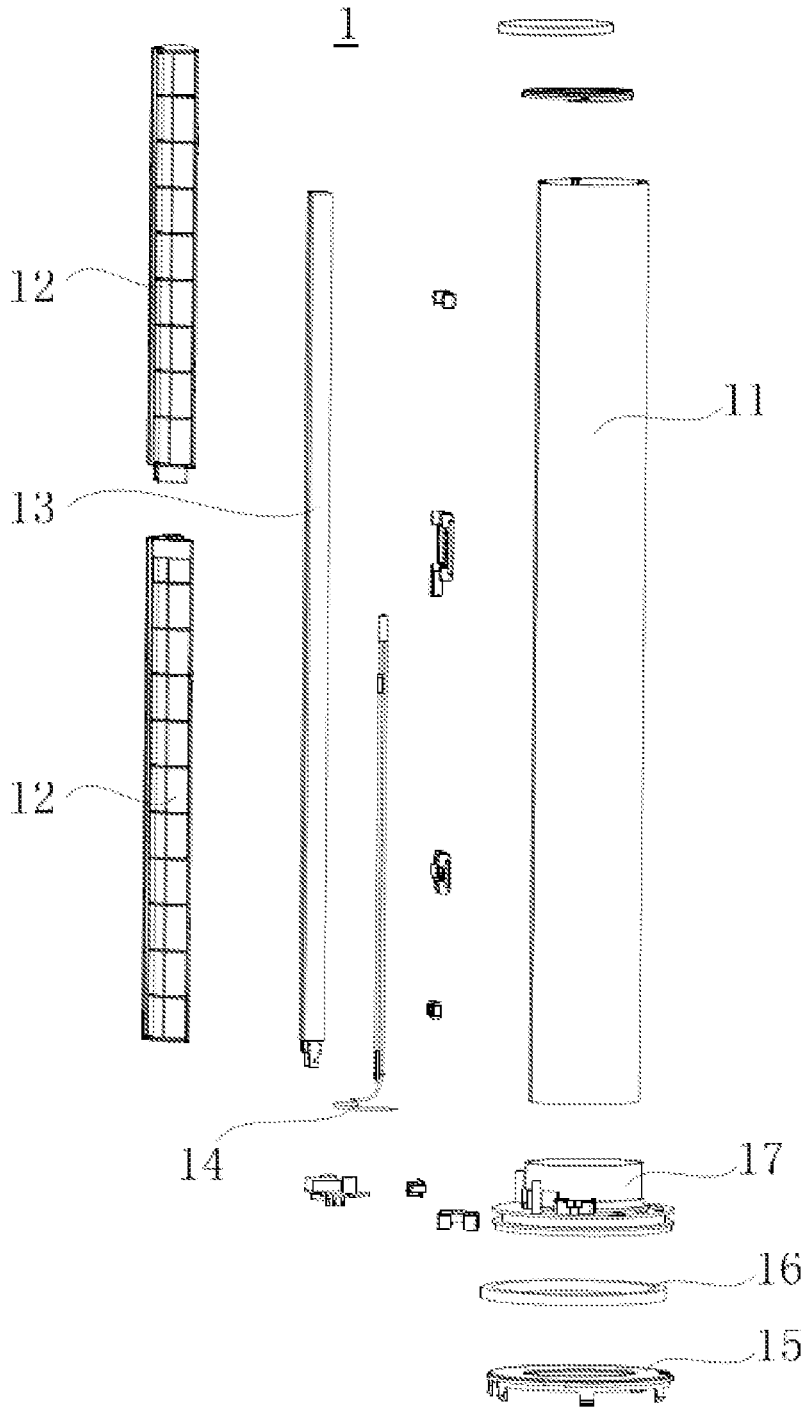
FIG. 19 is a schematic diagram of an exploded state of a nozzle of a bladeless fan according to an embodiment of the present disclosure.
Figure 20:
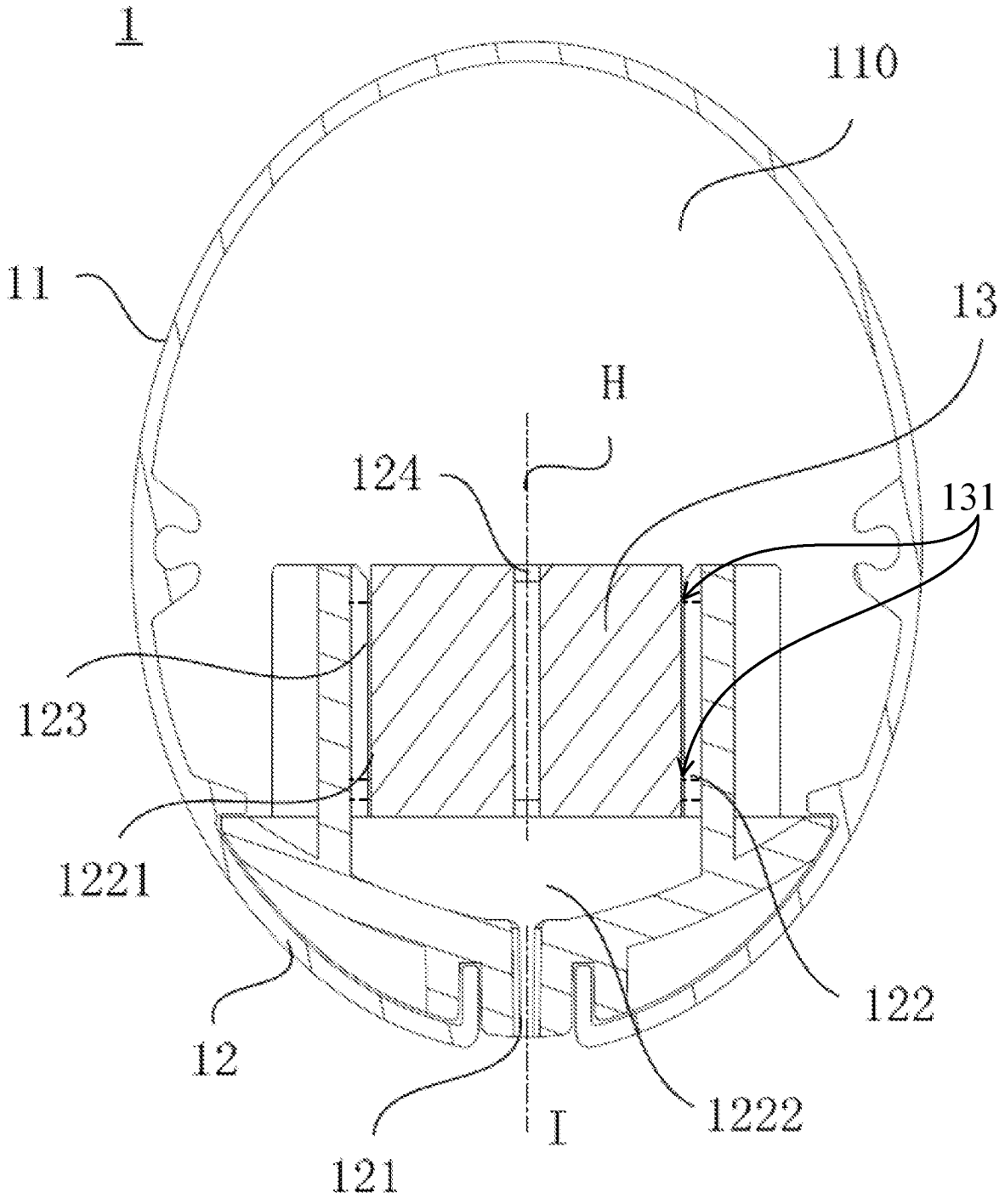
FIG. 20 is a cross-sectional view of a nozzle of a bladeless fan according to an embodiment of the present disclosure.
Figure 21:
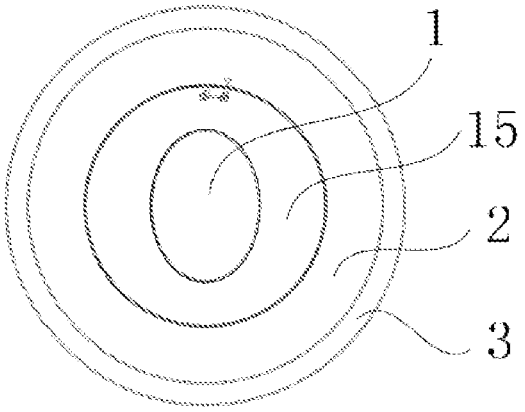
FIG. 21 is a top view of a bladeless fan according to an embodiment of the present disclosure.
Figure 22:
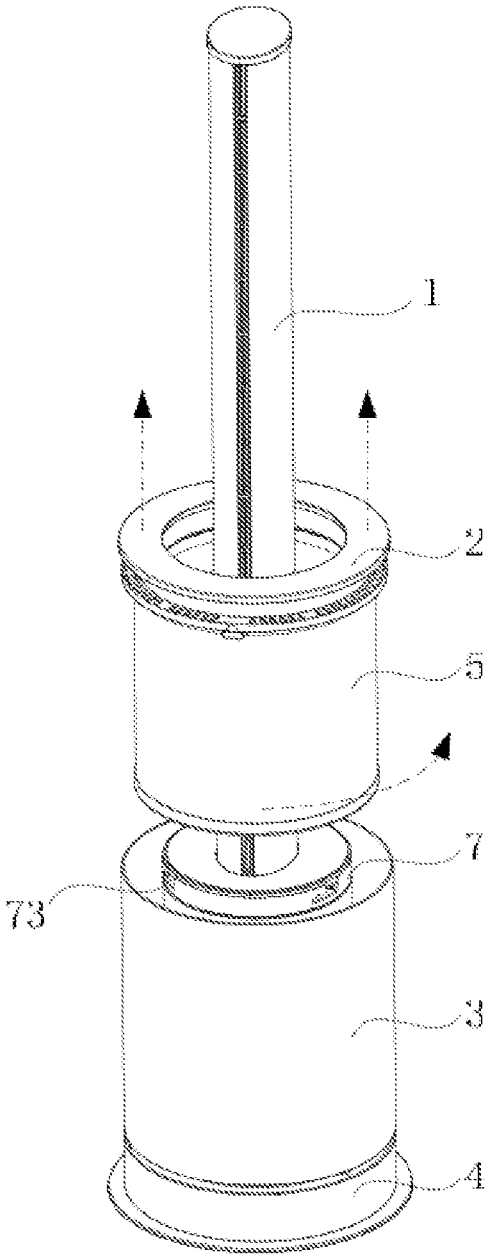
FIGS. 22 to 27 are schematic diagrams of various states when a filter frame of a bladeless fan is replaced according to an embodiment of the present disclosure.
Figure 23:
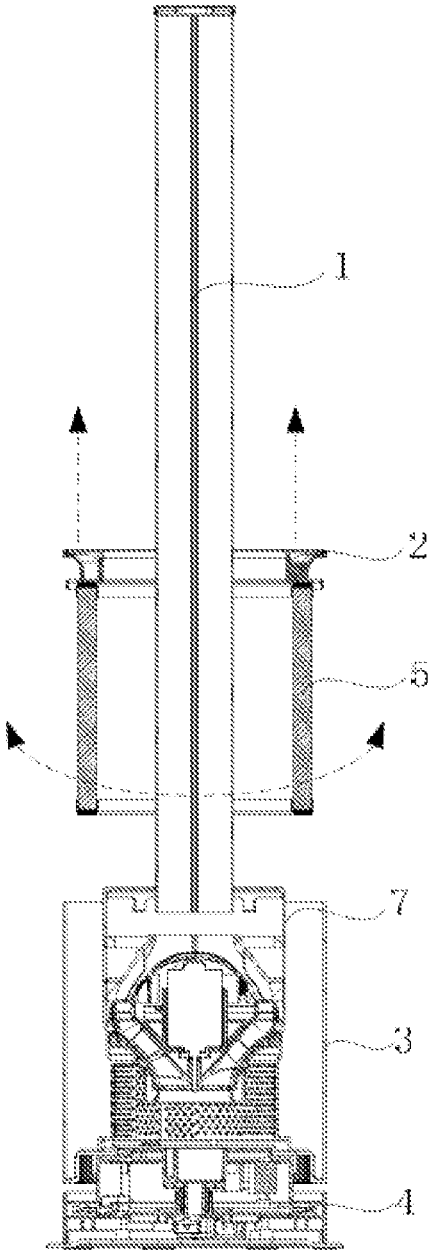
Figure 24:
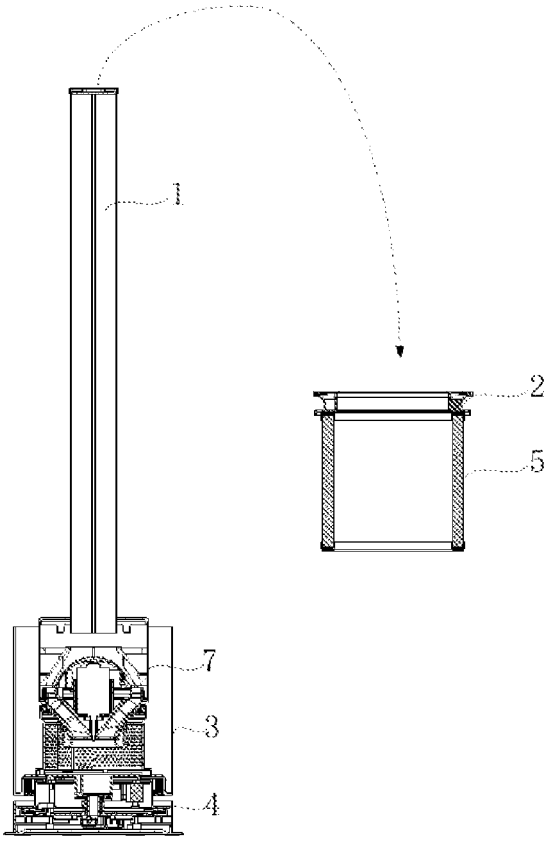
Figure 25:
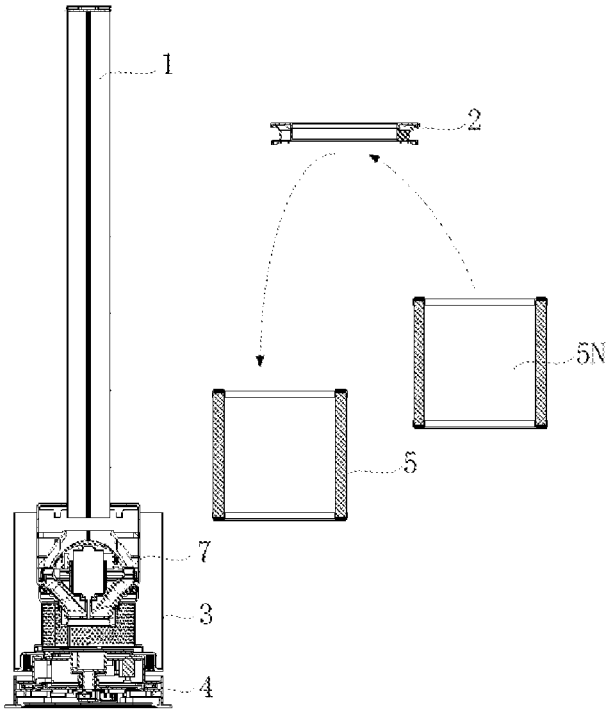
Figure 26:
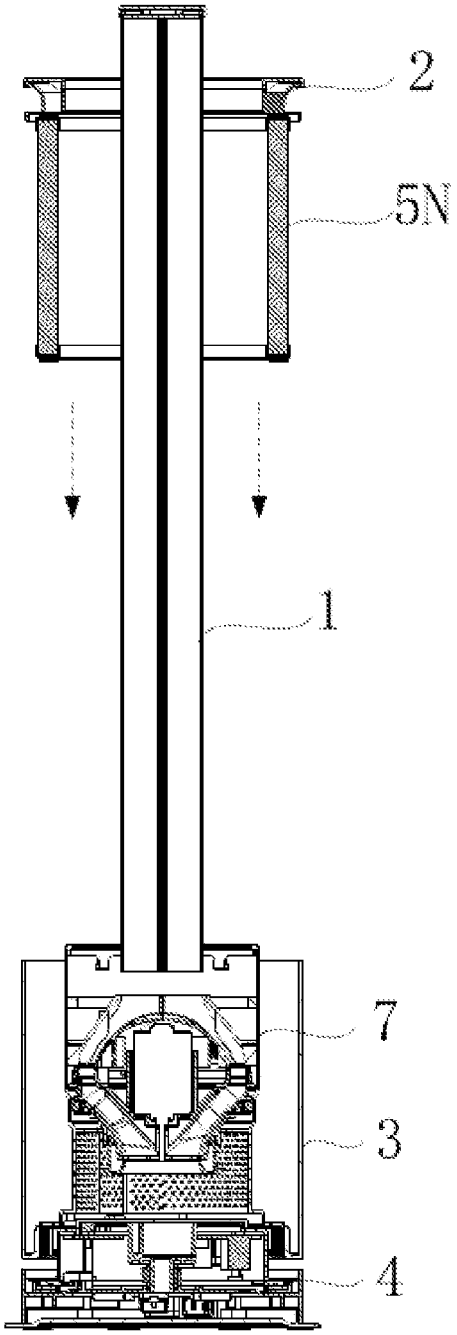
Figure 27:
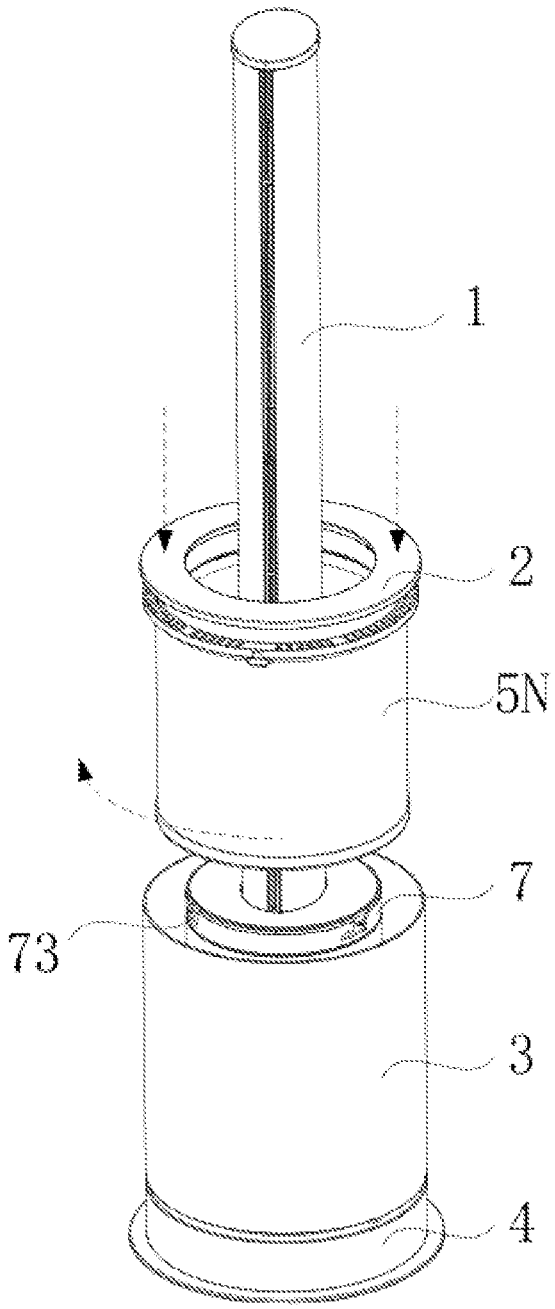

FIG. 19 and FIG. 20 are a schematic diagram of an exploded state and a cross-sectional view of a nozzle of a bladeless fan according to an embodiment of the present disclosure, and FIG. 21 is a top view of the bladeless fan. As shown in FIGS. 19 to 21, the nozzle 1 in the embodiment includes a sleeve 11, two accessories 12, a heater 13, a cable 14, a cover 15, a fifth circular sealing element 16 and a fastener 17. The heater 13 is provided on the accessories 12. The sleeve 11 is sealed with the fan motor unit 6 through a fifth circular sealing element 16, which is preferably a sponge. The purified and pressurized airflow from the fan motor unit 6 can be further heated in the nozzle 1 and then sprayed out. Wherein, in the inner passage 110 of the sleeve 11, each accessory 12 is provided with a plurality of outlets of the nozzle 121 and an air collecting chamber 122. Both the air collecting chamber 122 and the outlets of the nozzle 121 are arranged on the attachment 12 which is detachably nested in the sleeve 11. This structure is easier to manufacture, and also is more conducive to the disassembly and maintenance of the heater 13, as well as to the disassembly and clean of air collecting chamber 122 and the outlet of the nozzle 121, etc. Further, the accessory 12 includes a mouth at the front part and a shell 52 of the air collecting chamber connected with the rear part of the mouth. A plurality of outlets of the nozzle 121 are longitudinally distributed on the mouth, an air collecting chamber 122 is formed inside the shell 52. The wall of the sleeve 11 is provided with a longitudinally penetrating opening 25 for connecting the mouth, the inner wall of the sleeve 11 is provided with two longitudinal positioning grooves located on both sides of the inner of the longitudinally penetrating opening 25, and the two accessories 12 are respectively fixed in the longitudinal positioning grooves.

In this embodiment, the air collecting chamber 122 includes a first chamber 1221 and a second chamber 1222 communicating with the first chamber 1221; the portion between the inlet 124 of the air collecting chamber 122 and the second chamber is the first chamber 1221, and the portion between an end of the first chamber and the outlet of the air collecting chamber is the second chamber 1222; the heater 13 is arranged in the first chamber 1221, the airflow passing through the heater 13 and the airflow passing through the insulation passage 123 both enter the second chamber 1222 and are conveyed from the outlet of the air collecting chamber 122 to the outlet of the nozzle 121. Further, a plurality of support ribs 131 are arranged in the insulation passage 123, and one end of support rib 131 is connected to an inner wall of the air collecting chamber 122, and another end of support rib 131 is abutted to an outer wall of the heater 13. The air collecting chamber 122, the heater 13 and the outlet of the nozzle 121 are arranged on a central plane, that is, the longitudinal center plane H of the air collecting chamber 122 and the heater 13 and the longitudinal center plane I of the outlet of the nozzle 121 are the same plane. Therefore, the airflow is heated by the heater 13 and then is discharged through the outlet of the nozzle 121 in a straight manner, without turning or changing direction during the process, which can avoid the heat loss of the hot airflow during the output process and then improve the thermal efficiency of the fan. At the same time, when the cold air is blown, i.e. when the temperature control switch is closed, the output efficiency of the airflow can also be improved, and the air supply distance can be extended, etc. Moreover, the projection of the outer shell 11 on the plane where the air inlet cover unit 2 is located is located within an annular range of the air inlet cover unit 2, and the up and down movement of the air inlet cover unit 2 in the first direction is not restricted, which ensures that the air inlet cover unit 2 can be lifted out or pressed into the outer shell 3.

FIGS. 22 to 27 are schematic diagrams of various states when a filter frame of a bladeless fan is replaced according to an embodiment of the present disclosure. As shown in FIG. 22 to FIG. 27, when replacing the filter 5, by rotating the air inlet cover unit 2, separate the buckles 221 of the air inlet cover unit 2 from the groove 73 of the inner shell 7, and then lift the outer shell 3 along the periphery of nozzle 1 until its height exceeds the height of the nozzle 1, in above state, the filter 5 can be taken out. Further, separate the buckles 224 of the air inlet cover unit 2 from the slots 56 of the filter 5, and then remove the used filter 5 from the air inlet cover unit 2, replace it with a new air filter 5, and engage the buckles 224 and the slots 56. Finally, press the air inlet cover unit 2 with the filter 5 into the outer shell 3 along the periphery of nozzle 1 and then rotate until it is locked. The bladeless fan in the embodiment only needs one disassembly of one component and only one replacement of the filter frame, which greatly reduces the workload and time for the replacement and improves the user-friendly experience.

To sum up, the purpose of the present disclosure is to provide a bladeless fan for purifying air, which makes the airflow pass through the filter more evenly, thereby prolonging the life of the filter, reducing the replacement of the filter and reducing the cost of the air purifier. It is more conducive to the improvement of the indoor environment and provides a cleaner living environment. This technology is beneficial to the improvement of the indoor environment and then provides a cleaner living environment.

Although some embodiments of the present disclosure have been described, those skilled in the art can make additional changes and modifications to these embodiments once they learn the basic inventive concept. Therefore, what is claimed is intended to be interpreted by the embodiments hereof and all changes and modifications that fall within the scope of the claims of the present disclosure.

It will be apparent to those skilled in the art that various modifications and variations can be made to the present disclosure without departing from the inventive spirit and scope of the present disclosure. If any modifications and variations of the present disclosure fall within the scope of the claims of the present disclosure or its equivalent, the present disclosure is intended to include those modifications and variations.

What is claimed is:

1. A fan comprising:

a body comprising a first air inlet, a second air inlet, an air outlet and a fan motor unit for generating an airflow flowing through the body, wherein, the first air inlet and the second air inlet are arranged at intervals along a first direction;

a nozzle connected to the air outlet, the nozzle being arranged to receive the airflow from the body and to eject the airflow; and a filter mounted in the body and located between the first air inlet and the second air inlet, and disposed downstream of the first air inlet and the second air inlet;

wherein a heater is provided in an inner passage of the nozzle, and at least a part of the airflow received in the inner passage passes through the heater and is discharged from an outlet of the nozzle, and a longitudinal center plane of the outlet of the nozzle and a longitudinal center plane of the heater are parallel to each other or on a same plane;

wherein the inner passage of the nozzle is provided with an air collecting chamber, the air collecting chamber is provided with the heater, an inlet of the air collecting chamber is communicated with the inner passage, and an outlet of the air collecting chamber is communicated with the outlet of the nozzle, an insulation passage is formed between the heater and an inner wall of the air collecting chamber, wherein after the airflow received in the inner passage enters the air collecting chamber from the inlet of the air collecting chamber, a part of the airflow passes through the heater and another part of the airflow passes through the insulation passage;

wherein an airflow passing through the heater and an airflow passing through the insulation passage are both conveyed from the outlet of the air collecting chamber to the outlet of the nozzle, and a plurality of support ribs are arranged in the insulation passage, wherein one end of each support rib is connected to the inner wall of the air collecting chamber, and another end of each support rib is abutted to an outer wall of the heater.

2. The fan according to claim 1, wherein the air collecting chamber includes a first chamber and a second chamber communicating with the first chamber; a portion between the inlet of the air collecting chamber and the second chamber is the first chamber, and a portion between an end of the first chamber and the outlet of the air collecting chamber is the second chamber; the heater is arranged in the first chamber, both the airflow passing through the heater and the airflow passing through the insulation passage enter the second chamber and are conveyed from the outlet of the air collecting chamber to the outlet of the nozzle.

3. The fan according to claim 2, wherein the outlet of the air collecting chamber is configured as a tapered structure, and the tapered structure comprises two air guide surfaces that gradually taper from the air collecting chamber to the outlet of the nozzle, and the two guide surfaces are symmetrically arranged on relative to a center of the outlet of the nozzle.

4. The fan according to claim 3, wherein the body comprises an outer shell, the first air inlet and the second air inlet are respectively provided at two ends of the outer shell, and at least a portion of the outer shell forms a diffusion passage that guides the airflow into the filter.

5. The fan according to claim 2, wherein the body comprises an outer shell, the first air inlet and the second air inlet are respectively provided at two ends of the outer shell, and at least a portion of the outer shell forms a diffusion passage that guides the airflow into the filter.

6. The fan according to claim 1, wherein the body comprises an outer shell, the first air inlet and the second air inlet are respectively provided at two ends of the outer shell, and at least a portion of the outer shell forms a diffusion passage that guides the airflow into the filter.

7. The fan according to claim 6, wherein an upstream surface of the filter is exposed to the diffusion passage.

8. The fan according to claim 6, wherein the first direction is a direction along a height of the body.

9. The fan according to claim 6, wherein the outer shell is round barrel-shaped; the filter comprises a tubular filter and the tubular filter is arranged on an inner circumference of the round barrel-shaped outer shell, and a tubular gap between an upstream surface of the tubular filter and an inner wall of the barrel-shaped outer shell forms the diffusion passage.

10. The fan according to claim 9, wherein the body further comprises an air inlet cover unit, the cover unit is detachably connected to an opening of the round barrel-shaped outer shell; the first air inlet surrounding the tubular filter is arranged along an edge of the cover unit, and the first air inlet communicates with a first end of the diffusion passage.

11. The fan according to claim 10, wherein one side of the cover unit is provided with a circumferential positioning groove, and the circumferential positioning groove is detachably engaged with a first side of the tubular filter, and the first side of the tubular filter and the cover unit are sealed by a circular sealing element.

12. The fan according to claim 10, wherein a second side of the tubular filter abuts a bottom of the barrel-shaped outer shell, and the second side of the tubular filter and the outer shell are sealed by a circular sealing element.

13. The fan according to claim 10, wherein the second air inlet arranged around the tubular filter is disposed on an edge of a bottom of the barrel-shaped outer shell, and the second air inlet communicates with a second end of the diffusion passage.

* * * * *